US007444813B1

(12) United States Patent
Barvosa-Carter

(10) Patent No.: US 7,444,813 B1
(45) Date of Patent: Nov. 4, 2008

(54) VOLUME-CONVERSION TECHNIQUES FOR ACTIVE-MATERIALS-BASED MORPHING STRUCTURES

(75) Inventor: William Bernard Barvosa-Carter, Ventura, CA (US)

(73) Assignee: HRL Laboratories; LLC, Malibu, CA (US)

( * ) Notice: Subject to any disclaimer, the term of this patent is extended or adjusted under 35 U.S.C. 154(b) by 342 days.

(21) Appl. No.: 11/207,484

(22) Filed: Aug. 19, 2005

(51) Int. Cl.
*F15B 7/06* (2006.01)
*F15B 21/00* (2006.01)

(52) U.S. Cl. ..... 60/533; 60/545; 91/5

(58) Field of Classification Search ..... 60/533, 60/537, 545, 571; 91/5
See application file for complete search history.

(56) References Cited

U.S. PATENT DOCUMENTS 2,615,379 A * 10/1952 De Groff ..... 396/502
5,045,064 A * 9/1991 Idriss ..... 604/132
5,891,097 A * 4/1999 Saito et al. ..... 604/141
6,349,903 B2 2/2002 Caton et al.
6,405,532 B1 6/2002 Shahinpoor et al.
7,258,347 B2 * 8/2007 Keefe et al. ..... 277/628

* cited by examiner

*Primary Examiner*—Michael Leslie
(74) *Attorney, Agent, or Firm*—Tope-McKay & Associates

(57) ABSTRACT

Described is a volume-conversion structure for causing a volume transfer. The volume-conversion structure includes a first reservoir and a second reservoir. The first reservoir includes a first volume for holding a fluid therein. An actively deformable material structure (ADMS) is disposed around the first reservoir, with the ADMS being responsive to a deformation activation element to change the ADMS' shape to cause compression of the first reservoir. The second reservoir is in fluid communication with the first reservoir. The second reservoir has a first-second reservoir configuration and a second-second reservoir configuration. Actuation of the deformation activation element causes compression of the ADMS, thereby compressing the first reservoir to have a smaller second volume and displace the fluid from the first reservoir to the second reservoir to change the second reservoir's configuration from the first-second reservoir configuration to the second-second reservoir configuration.

36 Claims, 9 Drawing Sheets

VOLUME-CONVERSION TECHNIQUES FOR ACTIVE-MATERIALS-BASED MORPHING STRUCTURES

FIELD OF INVENTION

The present invention relates to a volume-conversion technique and, more particularly, to active material-based structures that alter their volumes upon command.

BACKGROUND OF INVENTION

Typically, an active material is used to produce useful work or a structural shape alteration through changes in length. Changing the length to produce a useful effect operates if the application and the properties of the active material (e.g., the specific force, stress, pressure, and strain capability) are well-matched. However, in most applications there is not a good match between a particular application and corresponding active material properties. A strategy for modifying the force/displacement output of the active material is to use lever-type mechanisms or other structural means to amplify or reduce stroke, with a concomitant change in output force. Such mechanisms can be complex and prone to failure.

Another common issue with active materials is the issue of power-off hold. In order to retain the desired shape change, the active material must be continuously powered. Because the active material must be continuously powered, the material is unable to retain its shape when powered off. This is particularly problematic where the active material is activated intermittently or remotely.

A few patents have been issued that disclose variable volume devices. U.S. Pat. No. 6,405,532, issued to M. Shahinpoor and K. J. Kim (hereinafter "the Shaninpoor patent"), describes a bladder-type actuator where the force transfer is accomplished through the uptake and release of hydrogen gas by a metal hydride into an inflatable bladder or variable volume device. While a metal hydride may be considered as a volume within which the gas is compressed, the Shahinpoor patent does not disclose using active materials or other mechanisms to accomplish similar goals, or to accomplish power-off hold of the actuator. Additionally, the Shahinpoor patent does not disclose possibilities for distributed actuation of larger or more complex structures.

U.S. Pat. No. 6,349,903, issued to J. H. Caton et. al; (hereinafter "the Caton patent") describes flexible reinforced elastomeric control surfaces that may be actuated through the use of pneumatically actuated bladders or shape memory alloy wires embedded in the elastomer. As with the Shahinpoor patent, the Caton patent does not disclose the use of active materials to accomplish changes in volume of the bladders, or methods by which the motion of the control surfaces may be fixed without a continued application of power.

Thus, a continuing need exists for a volume-conversion technique that constricts a volume using an active material, and uses a force transfer medium that might be reversibly or irreversibly frozen in place.

SUMMARY OF INVENTION

The present invention relates to a volume-conversion structure for causing a volume transfer. The volume-conversion structure includes both a first reservoir and a second reservoir. The first reservoir has a first volume for holding a fluid therein and includes a compressible surface area. An actively deformable material structure is disposed around the first reservoir. The actively deformable material structure is responsive to a deformation activation element to change the actively deformable material structure's shape to cause compression of the first reservoir.

The second reservoir is in fluid communication with the first reservoir. The second reservoir includes a first-second reservoir configuration and a second-second reservoir configuration. Actuation of the deformation activation element causes compression of the actively deformable material structure, thereby compressing the first reservoir to have a smaller second volume and displace the fluid from the first reservoir to the second reservoir to change the second reservoir's configuration from the first-second reservoir configuration to the second-second reservoir configuration.

In another aspect, the actively deformable material structure is disposed around the first reservoir in a form selected from a group consisting of being a material forming the compressible surface area and being separately formed and circumferentially attached with the compressible surface area.

In yet another aspect, the change from the first-second reservoir configuration to the second-second reservoir configuration is in a form selected from a group consisting of a change in length of the second reservoir, a change in volume of the second reservoir, and a change in geometry of the second reservoir.

The present invention further comprises a piston operably connected with the second reservoir such that a change in the second reservoir's configuration from the first-second reservoir configuration to the second-second reservoir configuration causes the piston to move from a first position to a second position.

In another aspect, the first-second reservoir configuration includes a length with the length rolled onto itself, thereby forming a rolled structure, such that when changed to the second-second reservoir configuration, the rolled structure unrolls and extends out.

In yet another aspect, the second reservoir includes a plurality of branches, such that first-second reservoir configuration is a deflated branched structure, and when the fluid is displaced from the first reservoir into the second reservoir, the second-second reservoir configuration is an expanded branched structure.

The present invention further comprises an actively controllable valve positioned between the first reservoir and the second reservoir. The valve is positioned such that it controls the fluid connection between the two reservoirs such that once the fluid is displaced from the first reservoir to the second reservoir, the valve prevents the fluid from returning to the first reservoir, thereby holding the second reservoir in the second-second reservoir configuration.

The present invention further comprises a freezable fluid disposed within the first reservoir. The freezable fluid has a liquid and a solid form, such that when in the liquid form, the freezable fluid may be displaced from the first reservoir to the second reservoir, and once in the second reservoir, when conditions allow, the freezable fluid solidifies to take a solid form, thereby maintaining the second reservoir in the second-second reservoir configuration.

In yet another aspect, the freezable fluid is a selectively deformable material structure.

The present invention further comprises at least two rigid plates connected with the second reservoir such that the second reservoir is sandwiched between the two rigid plates, thereby forming a variable-stiffness beam. As an increasing amount of the freezable fluid is disposed within the second reservoir, a width of the second reservoir increases and thereby forces the two rigid plates further apart, such that when the freezable fluid is within the second reservoir it may be frozen to form a stiff beam, and as the width of the reservoir increases, the stiffness of the second reservoir increases.

The present invention further comprises a skin element disposed around the second reservoir. The skin element includes a variable stiffness and is responsive to a second deformation activation element, such that the flexibility of the skin element can be altered upon actuation of the second deformation activation element, allowing a user to hold the second reservoir in the second-second reservoir configuration after the fluid has been allowed to leave the second reservoir.

In another aspect, the skin element is formed of a shape memory polymer.

Finally, as can be appreciated by one in the art, the present invention further comprises methods for forming and using the volume-conversion structure described herein.

BRIEF DESCRIPTION OF THE DRAWINGS

The objects, features and advantages of the present invention will be apparent from the following detailed descriptions of the various aspects of the invention in conjunction with reference to the following drawings, where.

DETAILED DESCRIPTION

Figure 1:
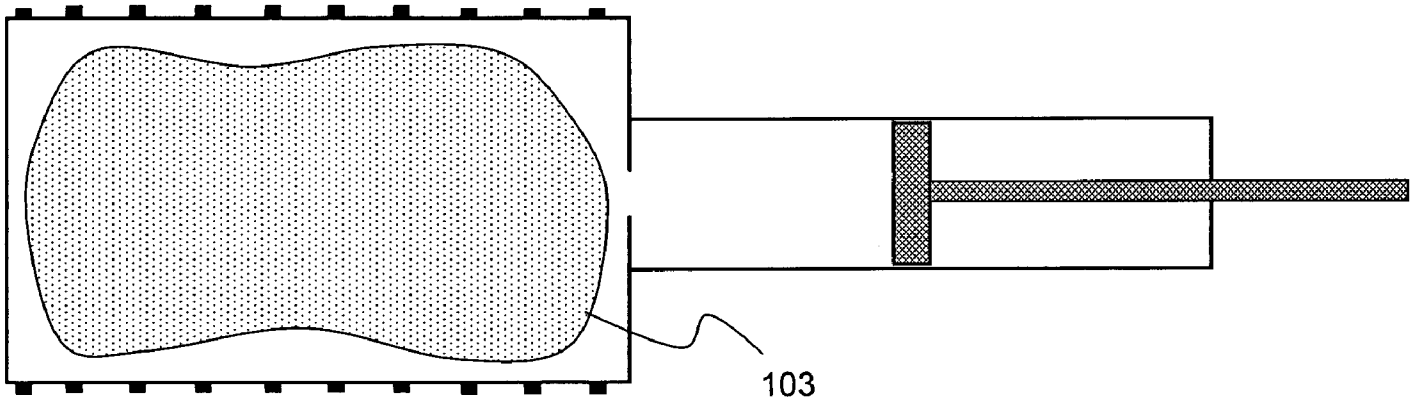
FIG. 1 is a side-view illustration of a volume-conversion actuator according to the present invention, showing a length-changing active material wrapped around a flexible exterior first reservoir, with a second reservoir connected with the first reservoir.

The present invention relates to a volume-conversion technique using active material-based structures that alter their volumes upon command, which may be tailored to a variety of applications. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

Before describing the invention in detail, first a glossary of terms used in the description and claims is given as a central resource for the reader. Next, a description of various principal aspects of the present invention is provided. Third, an introduction is provided to provide the reader with a general understanding of the present invention. Finally, a description of various aspects of the present invention is provided to give an understanding of the specific details.

(1) Glossary

Before describing the specific details of the present invention, a glossary is provided in which various terms used herein and in the claims are defined. The glossary provided is intended to provide the reader with a general understanding for the intended meaning of the terms, but is not intended to convey the entire scope of each term. Rather, the glossary is intended to supplement the rest of the specification in more accurately explaining the terms used.

Activation Means—The term "activation means" refers to a mechanism or technique for transferring an actuation signal to a cell or group of cells. Non-limiting examples of activation means include the use of a conductor such as metallic wires, chemicals, heat conducting materials, a magnetic field, and an environment.

Active Material—The term "active material," also known as a smart material, refers to a material that changes its shape in response to an external control stimulus, or actuation signal.

Actively Deformable Material—An actively deformable material is a portion of an ADMS (see below) and is a material that changes shape in response to stimulation. The change in shape of an actively deformable material structure drives a change in the shape of a selectively deformable material structure and then the selectively deformable material structure is caused to retain a desired shape for the shaping element. Non-limiting examples of actively deformable materials include liquid crystal elastomers, shape memory alloys, magnetostrictive materials, electrostrictive materials, piezoelectric ceramics and polymers, electroactive polymers, ionic polymer gels, ionic polymer metal composites, dielectric elastomers, conductive polymers, carbon nanotubes, and ferrogels.

Actively Deformable Material Structure (ADMS)—An actively deformable material structure is comprised of an actively deformable material and may include a deformation activation element.

Deformation Activation Element—A deformation activation element is a mechanism for causing an actively deformable material to change shape or a selectively deformable material structure to become malleable or stiff. The exact configuration of a deformation activation element depends both on the mechanism by which the actively deformable material is induced to change shape or the selectively deformable material is caused to become malleable or stiff and the configuration of an active shaping element. As a non-limiting example, if the actively deformable material changes shape upon application of electric current, the deformation activation element could be a remotely or locally activated electrical circuit that allows current to flow to or through the actively deformable material. In this case, the electrical circuit would be activated when it was desired for the actively deformable material to actuate. As another non-limiting example, in the case of a selectively deformable material structure that becomes malleable when heat is applied, the deformation activation element could be a heating element embedded in the selectively deformable material structure. In this case, the heating element could be activated, heating the selectively deformable material structure, causing it to become malleable. The actively deformable material structure would then be actuated, causing a change in the shape of the active shaping element. The heating element could then be deactivated, allowing the structure to cool and become stiff, effectively "freezing" the active shaping element in its new shape. Generally, deformation activation elements working together permit the achievement of various deformation-types and act as a control mechanism for the deformation unit. Non-limiting examples of deformation types that may be generated by deformation activation elements include multi-directional bending-type deformation, stretching-type or contracting-type deformation, and twisting-type deformation.

Selectively Deformable Material Structure (SDMS)—A selectively deformable material structure is a portion of an active shaping element and is a material that can be made selectively malleable or stiff in response to stimulation. The change in shape of the selectively deformable material structure is driven by a change in the shape of an actively deformable material structure and then the selectively deformable material structure is caused to retain a desired shape for the shaping element (e.g., the selectively deformable material structure "freezes" to retain the shape into which it was driven by the actively deformable material structure). Non-limiting examples of selectively deformable material types that may be used with the present invention include thermally-activated phase transformation materials, thermally-activated glass-forming materials, optically-electrically or magnetically-activated variable viscosity or stiffness materials, and plastically-deformable materials. Non-limiting examples of specific phase transformation materials include elements and compounds which reversibly transform from a solid form to a fluid form, such as many metals and alloys, polymers, waxes, ice/water, etc. Non-limiting examples of specific glass-forming materials include shape memory polymers, amorphous metals, amorphous semiconductors, amorphous glasses, and amorphous polymers. Non-limiting examples of specific variable viscosity or stiffness materials include chalcogenide glasses, electrorheological fluids, electrorheological elastomers, magnetorheological fluids, and magnetorheological elastomers. Non-limiting examples of plastically deformable materials include metals, thermoplastics, baroplastics, and other polymers. In some cases, it may be desirable for the selectively deformable material structure to be capable of "setting" through a non-reversible mechanism. Non-limiting examples of materials that may be used in a non-reversible capacity include photopolymerizable materials, curable materials, irreversibly cross-linkable polymers, additively-induced curing materials, subtractively-induced curing materials, reactively-induced curing materials, signal-catalytically curing materials, crystallizing materials, sol gels, and thermally curing materials.

(2) Principal Aspects

The present invention has three "principal" aspects. The first is a volume-conversion structure for causing a volume transfer from a first reservoir to a second reservoir. As can be appreciated by one in the art, the structure may be used for a myriad of purposes where it is desirable to transfer a volume. The second principal aspect is a method for forming a volume-conversion structure, while the third principal aspect is a method for volume-conversion. These aspects will be described in more detail below.

(3) Introduction

The present invention relates to a volume-conversion technique using active material-based structures that alter their volumes upon command. Using at least two reservoirs, a volume of fluid or gas may be selectively transferred between the reservoirs. The volume transfer is accomplished through forming a first reservoir that includes an active material circumferentially disposed around the reservoir, with a second reservoir connected with the first reservoir. Actuation of the active material causes compression of the first reservoir, thereby decreasing its volume and forcing the fluid or gas into the second reservoir.

This invention disclosed herein allows for compact actuation systems that are lighter and more reliable than current hydraulic or pneumatic high-force high-displacement actuators. A particular circumstance where this invention is significantly advantageous is in smaller-scale actuators and distributed actuation systems, where the infrastructure associated with hydraulics or pneumatics becomes problematic and difficult to implement. Relative to other conventional compact actuation schemes, such as electromagnetics or electrostatics, the present invention also allows for higher forces.

This invention enables a new class of dynamically tailorable structures based on a combination of smart/active materials and conventional structural and elastic materials. Changes in length, area, or volume of an active material (e.g., shape memory alloys, piezoelectric or magnetostrictive materials, electroactive polymers, etc.) are utilized to enable transfer of a volume of a fluid or gas from the first reservoir to the second reservoir. Assuming sufficient incompressibility of the transfer medium, this transfer of volume is used to translate the force generated by the active material into some functional change of a structure. This might include displacement of a bladder or piston, unrolling or unfurling of a stowed structure, or an action that stiffens or changes the flexibility of a structural element. With additional functional elements in the system, this functional change can be engineered to persist without continuous activation of the active material. Such functional elements include actively controlled valves between the two reservoirs, a "freezable" force transfer medium (e.g., such as a wax or glass-forming polymer), or a skin element (existing at the perimeter of one or both reservoirs) with variable stiffness such as a shape memory polymer. Additional embodiments with multiple reservoirs and functional elements are also discussed.

The present invention enables compact, electrically and/or thermally activated actuation or adaptation of a structure. The actuation or shape change could be simple (e.g., linear, for instance as in a hydraulic or pneumatic piston) or complex (e.g., involving multiple mechanical routes for the working fluid to occupy and modify the structure), temporary (e.g., if the working fluid can be frozen in place and re-melted) or permanent (e.g., if the working fluid is a two-component epoxy).

Non-limiting examples of structures and applications that might be enabled by this concept include: expandable/retractable sun shields; dynamically variable stiffness struts, rails, shock absorbers, and seat cushions; deployable roof for convertibles; compact and electrically activated non-hydraulic point actuation; and deployable/morphing antenna or wing structures. Specific details of the invention are described in further detail below.

(4) Description

FIG. 1 illustrates a cross-sectional view of a volume-conversion structure 100 with the essential features of the present invention. The volume-conversion structure 100 includes a first reservoir 102 having a first volume for holding a fluid 103 therein, with a second reservoir 104 in fluid communication with the first reservoir 102. The first reservoir 102 has a circumferentially compressible surface area with an actively deformable material structure 106 circumferentially disposed around the first reservoir 102. The actively deformable material structure 106 is suitably disposed as to alter the volume of the first reservoir 102 by changing the surface area (e.g., compressing by contracting around) of the first reservoir 102.

Figure 2:
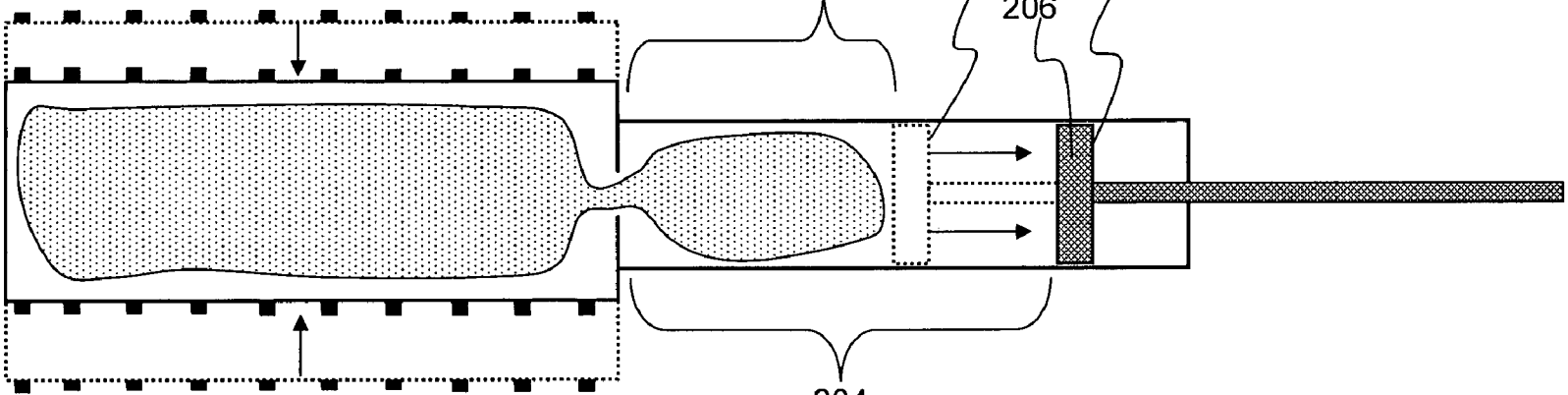
FIG. 2 is a side-view illustration of a volume-conversion actuator according to the present invention, showing an active material formed as an exterior surface of a reservoir.

As shown in FIG. 2, the actively deformable material structure 106 is responsive to a deformation activation element to change the actively deformable material structure's 106 shape and thereby cause compression of the first reservoir 102. Compressing the first reservoir 102 causes it to have a smaller second volume 200 and displace the fluid 103 from the first reservoir 102 to the second reservoir 104.

The second reservoir 104 has a first-second reservoir configuration 202 and a second-second reservoir configuration 204. When the first reservoir 102 is compressed by the actively deformable material structure 106 and the fluid 103 is displaced into the second reservoir 104, the second reservoir is forced to change from the first-second reservoir configuration 202 to the second-second reservoir configuration 204.

As shown, an active material (i.e., actively deformable material structure 106) that changes length is wrapped around a flexible exterior of the first reservoir 102, enabling compression upon activation of the active material. The volume of fluid 103 displaced through the action of the active material is forced into the second reservoir 104. By the action of the displaced volume of fluid 103, it is possible to effect a change in length, volume, or geometry in a structure associated with the second reservoir 104. This shape change could be simple or complex. As a non-limiting example and as shown in FIG. 2, the change from the first-second reservoir configuration 202 to the second-second reservoir configuration 204 causes displacement of a piston 206 from a first position 208 to a second position 210. However, as can be appreciated by one in the art, the displaced volume of fluid 103 could be utilized for a variety of changes in shape of a mechanical structure.

An advantage of the geometry of the present invention is that the overall displaced volume of fluid 103 is significantly greater than that of prior art configurations. In the tubular geometry shown in FIG. 1, at small active material displacements (as might be accomplished using shape memory alloy windings or sheet, −6%), the increase in displaced volume is a factor of two over what might be accomplished (as shown in prior art) by attaching the active material between the piston surface and the end of the cylinder. At large active material displacements (as might occur using dielectric elastomers, −100-200%, or liquid crystal elastomers, −30%), the volume-conversion scales as the square of the length change of the active material. Using a spherical geometry would accomplish a factor of three for small active deformations, or scale as the cube of the active dimension change at larger deformations.

Figures 3, 4:
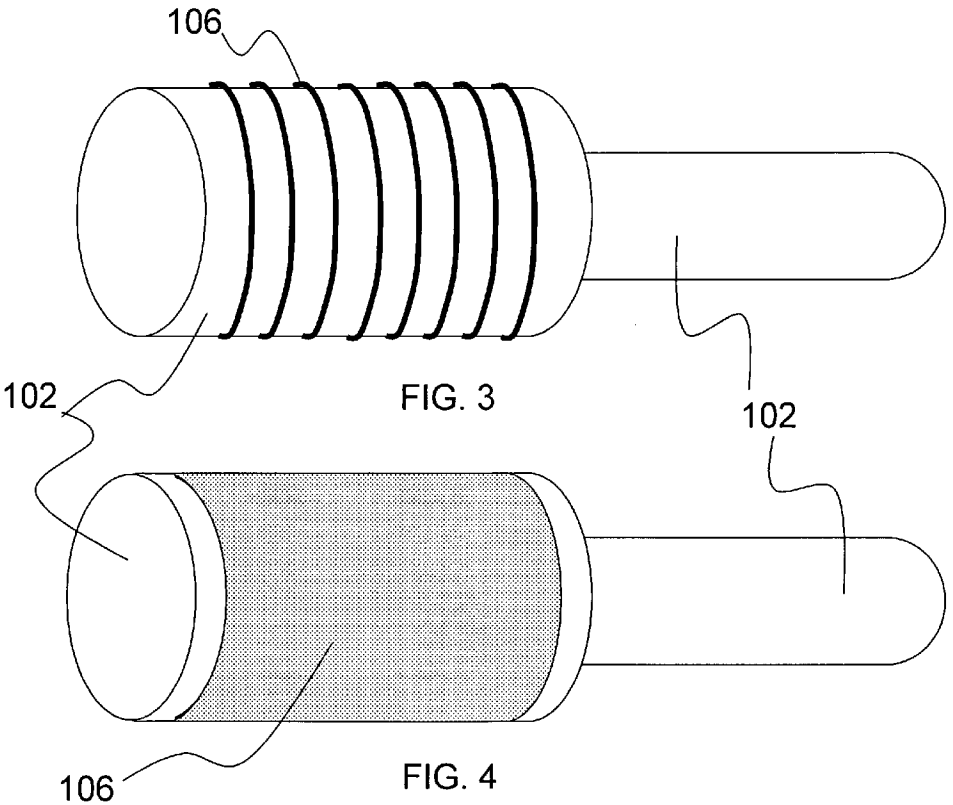
FIG. 3 is a cross-sectional view of the volume-conversion actuator of FIG. 1.
FIG. 4 is a cross-sectional view of the volume-conversion actuator of FIG. 1, showing activation of the active material and its modifying effect on volume.

Several techniques are possible for circumferentially disposing the actively deformable material structure 106 around the first reservoir 102. As a non-limiting example and as shown in FIG. 3, the actively deformable material structure 106 may be separately formed and circumferentially attached with the circumferentially compressible surface area (i.e., wrapped around the first reservoir 102). The actively deformable material structure 106 may be a single structure, or a plurality of structures wrapped around the first reservoir 102.

As another non-limiting example and as shown in FIG. 4, the actively deformable material structure 106 can be the material itself that forms the circumferentially compressible surface area and thereby forming the flexible exterior of the first reservoir 102. For example, a continuous film of a shape memory alloy or a wrapped film of dielectric elastomer could be used. In this case, as the dielectric elastomer is activated, the force balance between a pressurized reservoir and the elastomer skin is changed.

The present invention takes advantage of active materials that change length, area, or volume. Length changes are the most common, with shape memory alloys (SMAs), piezoelectrics, magnetostrictives, etc. . . . , all used primarily in this mode. Area changes can be induced in shape memory alloys, liquid-crystal elastomers, and dielectric elastomer type electroactive polymers. Volume changes can be induced directly in conductive polymers or electroactive polymer gels, or indirectly using porous or cellular forms of other active materials, including shape memory alloys and polymers, to transform changes in area to changes in volume.

The changes in length, area or volume are utilized to enable transfer of a fluid or gas from the first reservoir 102 to the second reservoir 104. Assuming sufficient incompressibility of the transfer medium, this transfer of volume is used to translate the force generated by the active material into some functional change of a structure, such as a change in length, volume, or geometry of the second reservoir 104. This might include displacement of and hence work done by a bladder or piston, as shown in FIG. 2. In this case, if the force transfer medium has sufficiently low viscosity, this can be accomplished highly efficiently.

Figures 5, 6:
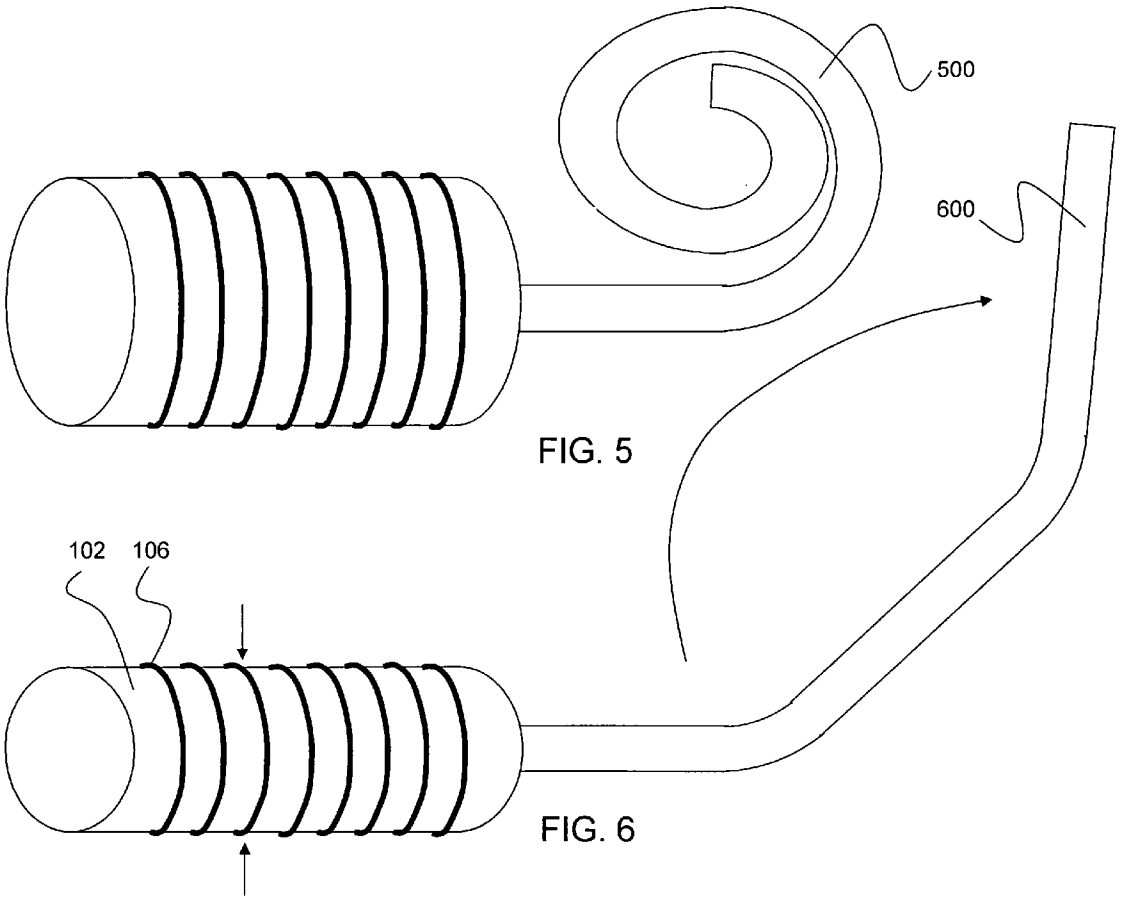
FIG. 5 is a side-view illustration of a volume-conversion actuator according to the present invention, where the second reservoir is in a rolled up configuration.
FIG. 6 is a side-view illustration of the volume-conversion actuator of FIG. 5, where the second reservoir is in an extended configuration.

An additional goal of this invention is to parlay this transfer of volume into some functional change of a structure, include unrolling or unfurling of a stowed structure, or some other related global topological change. As a non-limiting example and as shown in FIG. 5, the first-second reservoir configuration 500 includes a length with the length rolled onto itself, thereby forming a rolled structure. The rolled structure provides a compact structure allowing for easy storage. As shown in FIG. 6, when the actively deformable material structure 106 is actuated to compress the first reservoir 102, the second reservoir is changed to the second-second reservoir configuration 600. In this aspect, in the second-second reservoir configuration 600, the rolled structure unrolls and extends out to form an extended structure.

Figure 7:
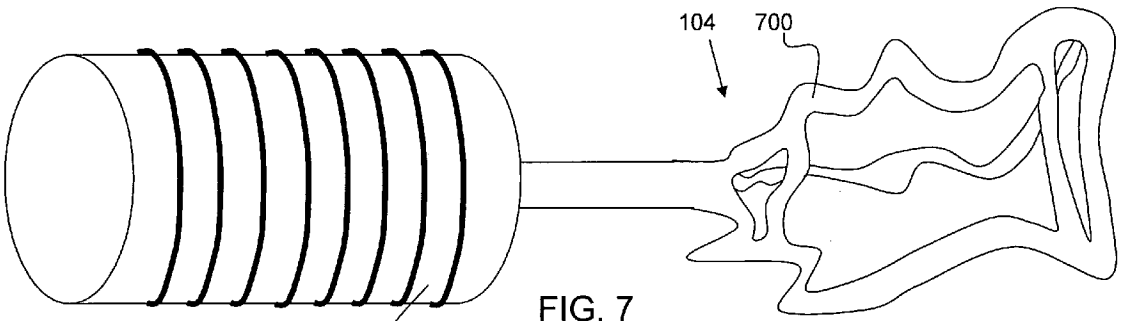
FIG. 7 is a side-view illustration of a volume-conversion actuator according to the present invention, showing the second reservoir having a branched structure.
Figure 8:
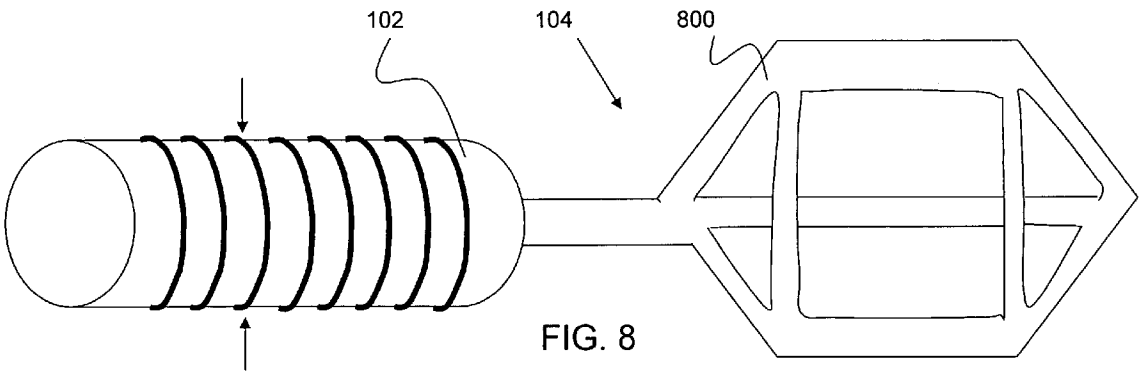
FIG. 8 is a side-view illustration of the volume-conversion actuator of FIG. 7, showing the second reservoir being erected to form an erect branched structure.

As another non-limiting example and as shown in FIGS. 7 and 8, it might be desirable to transfer the initial stored volume into a larger, branched structure (e.g., such as might be found along the "spars" of a flexible, expandable structure, like a tent, sun shade, or protective external structure). In this aspect, the second reservoir 104 includes a plurality of branches, such that first-second reservoir configuration is a deflated branched structure 700. As shown in FIG. 8, when the fluid is displaced from the first reservoir 102 into the second reservoir 104, the second-second reservoir configuration is an expanded branched structure 800.

An additional aspect of the present invention is to provide structures not only with the ability to do work and change shape, but also with the ability to hold the induced displacements in a power-off mode. This is accomplished by means of a variety of techniques. In one aspect, a functional element is included that stiffens or changes the flexibility of a structural member in the system. Non-limiting examples of such functional elements include actively controlled valves between the two reservoirs, a "freezable" force transfer medium (such as a wax or glass-forming oil or polymer), or a skin element (existing at the perimeter of one or both reservoirs) with variable stiffness such as a shape memory polymer.

Figure 9:
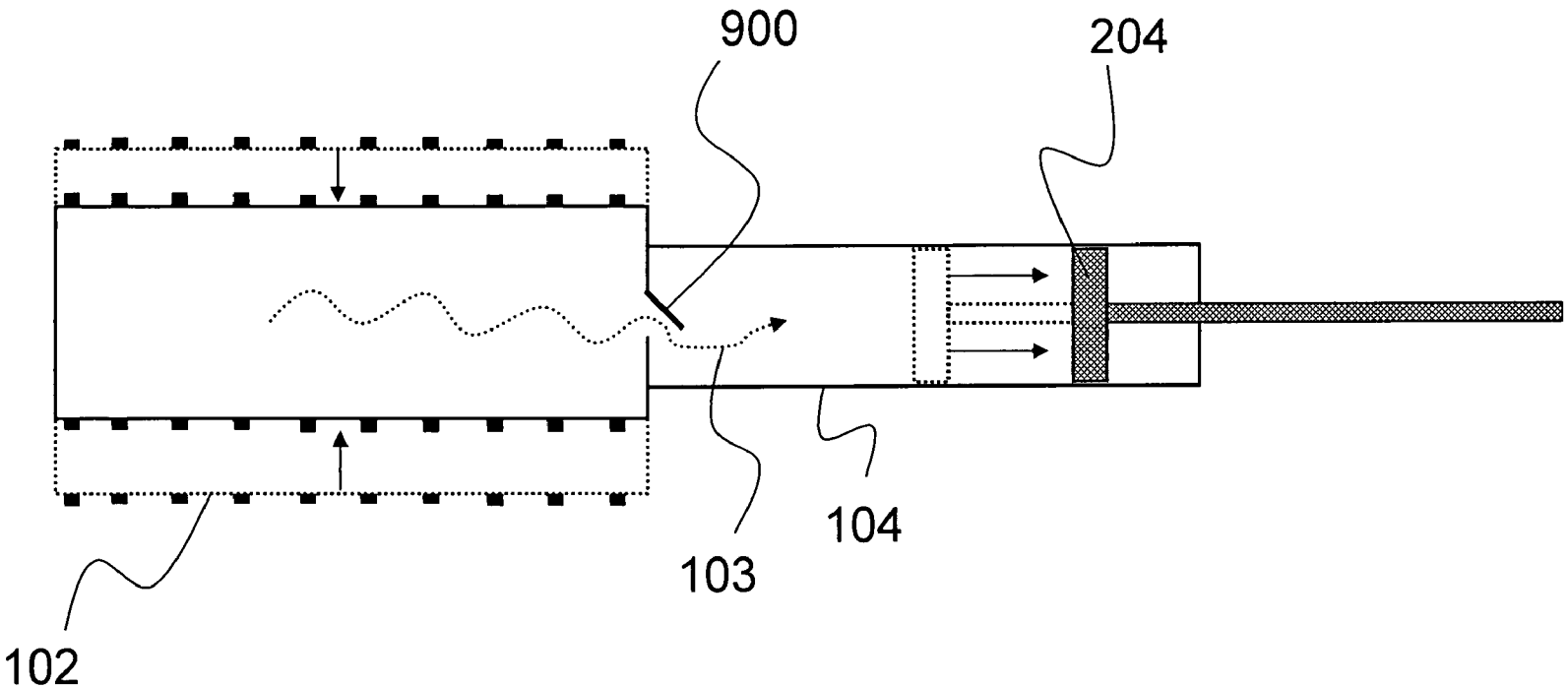
FIG. 9 is a cross-sectional view of the volume-conversion actuator of FIG. 1, showing a valve positioned between the first and second reservoirs.

As shown in FIG. 9, a valve 900 may be included to control the transfer of fluid 103 between the two reservoirs. The valve 900 is positioned between the first reservoir 102 and the second reservoir 104. Once the fluid 103 is displaced from the first reservoir 102 to the second reservoir 104, the valve 900 prevents the fluid from returning to the first reservoir 102, thereby holding the second reservoir in the second-second reservoir configuration 204. The valve 900 may be actively controllable, allowing a user to open the valve 900 and thereby allow the fluid 103 to return to the first reservoir 102.

Figures 10, 11, 12:
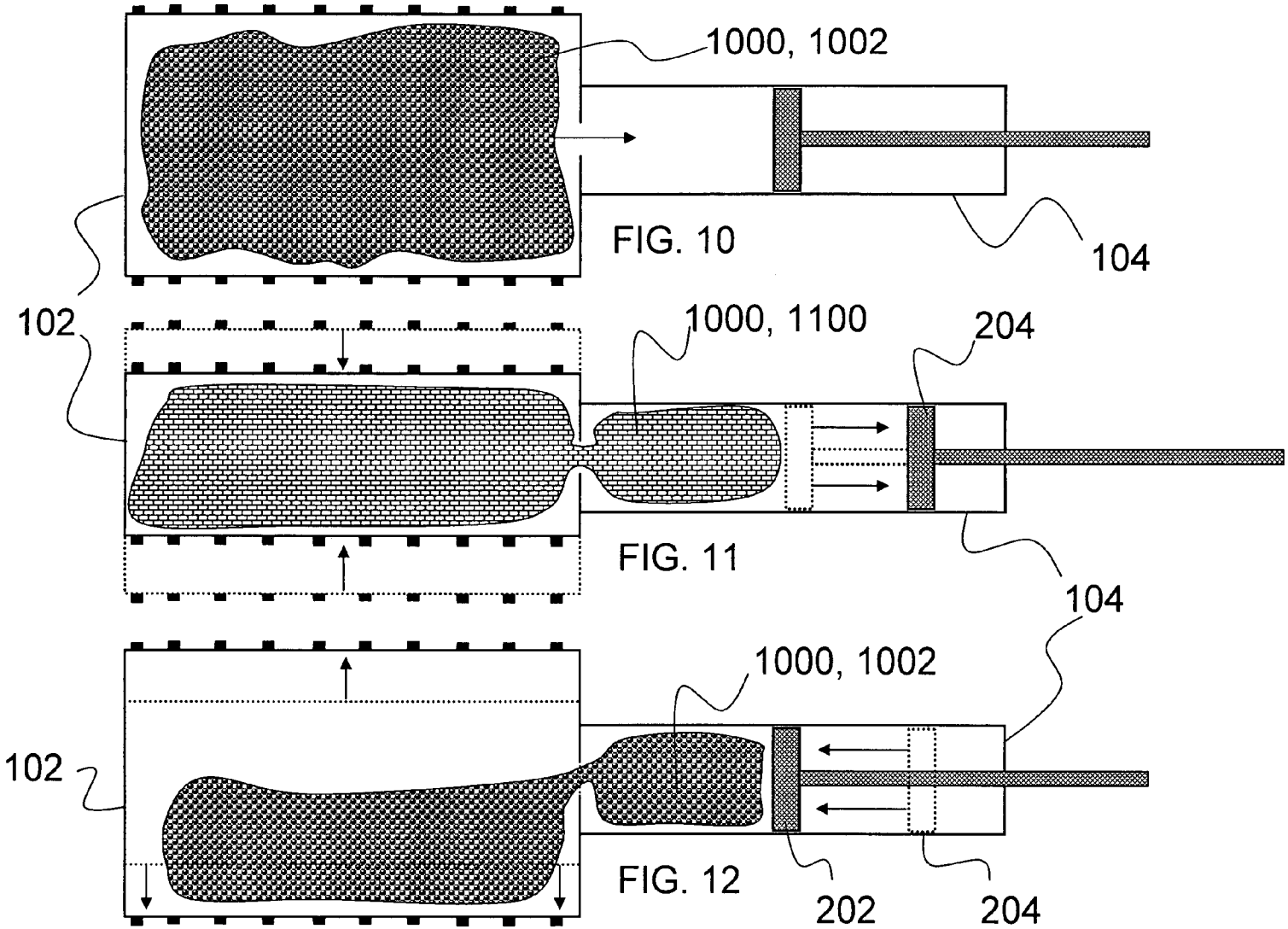
FIG. 10 is a cross-sectional view of the volume-conversion actuator of FIG. 1, showing a fluid or gas disposed within the first reservoir.
FIG. 11 is a cross-sectional view of the volume-conversion actuator of FIG. 10, showing the fluid or gas being displaced into the second reservoir, where it becomes a solid.
FIG. 12 is a cross-sectional view of the volume-conversion actuator of FIG. 11, showing the solid becoming a liquid or gas and moving back into the first reservoir.

In another aspect, and as shown in FIGS. 10 through 12, a freezable fluid 1000 may be used to hold the shape of the second reservoir 104. The freezable fluid 1000 has both a liquid 1002 and a solid 1100 form. In its liquid form 1002, the freezable fluid 1000 may be disposed within the first reservoir 102 and then displaced from the first reservoir 102 to the second reservoir 104. Once in the second reservoir 104, if conditions allow, the freezable fluid 1000 solidifies to take a solid form 1100, thereby maintaining the second reservoir 104 in the second-second reservoir configuration 204. The freezable fluid 1000 may thereafter be liquefied to its liquid form 1002 and passed back into the first reservoir 102, allowing the second reservoir 104 to change back from the second-second reservoir configuration 204 to the first-second reservoir configuration 202.

In order to selectively freeze and liquefy, the freezable fluid 1000 is a selectively deformable material structure that includes varying viscosities, such as both a liquid and solid form, non-limiting examples of which include glass-forming polymers, waxes, and ice/water.

In the case of a reversibly solidifying force transfer medium (i.e., freezable fluid), variable stiffness beams can be considered by varying the distance between two rigid face sheets (i.e., rigid plates). The stiffness of the beam would increase as the face sheets are forced apart, and the intervening force transfer medium is frozen in place, hence allowing the transfer of shear stresses from one sheet to the other. Such a concept applies to other engineering structures, such as plates, truss structures, airplane wings, etc.

Figure 13:
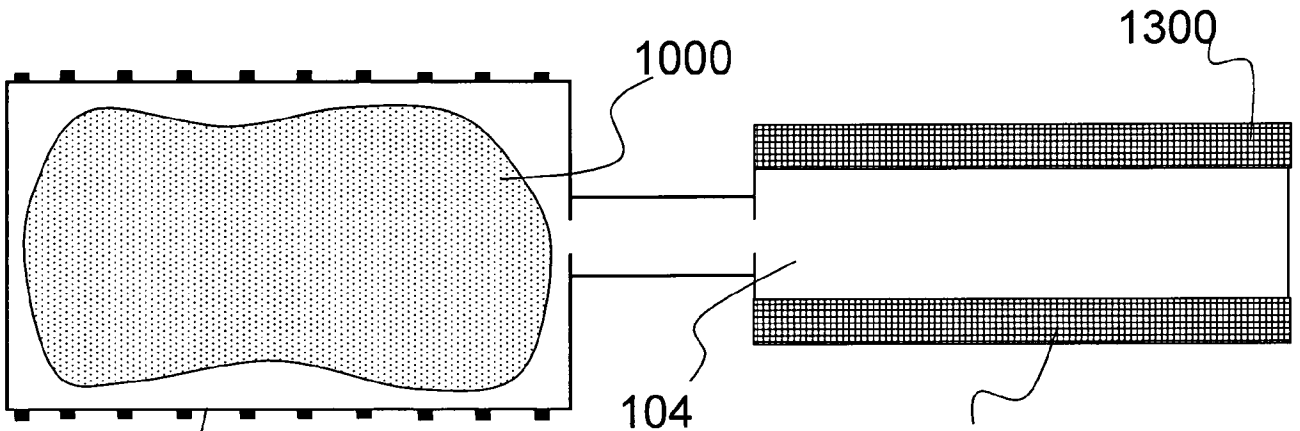
FIG. 13 is a cross-sectional view a volume-conversion structure according to the present invention, showing two rigid plates connected with the second reservoir.
Figure 14:
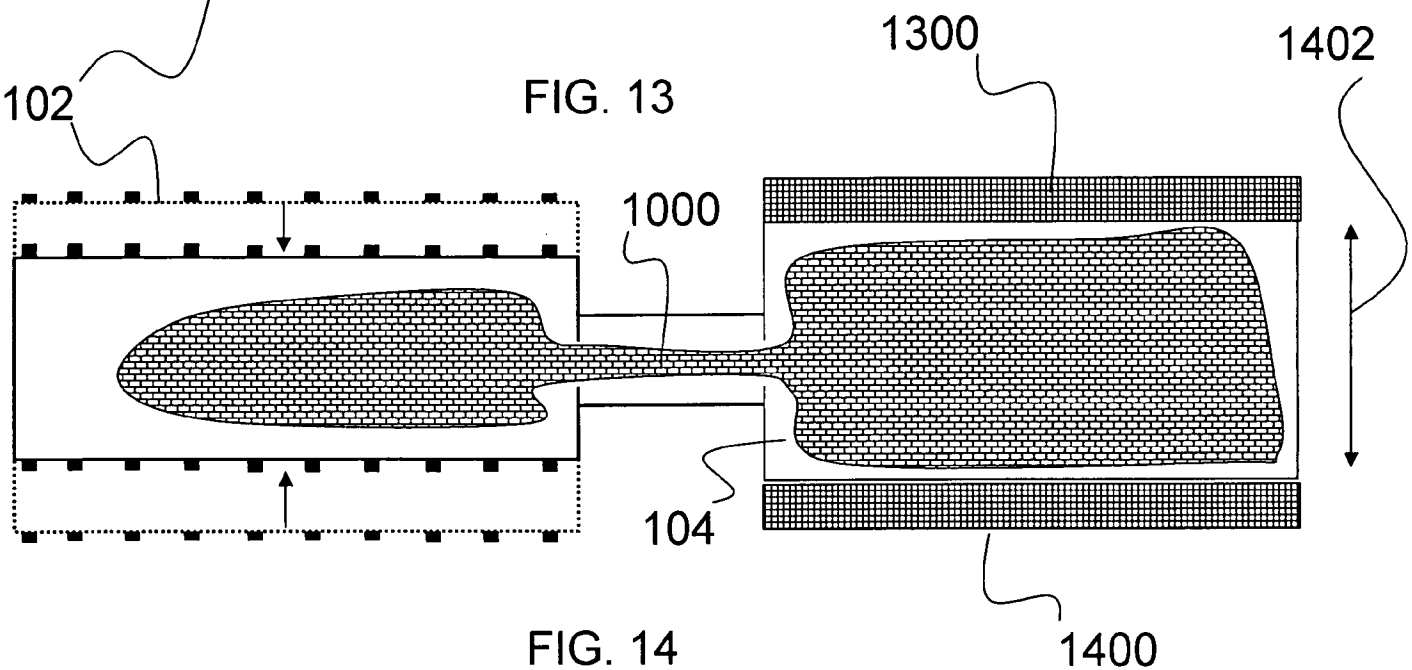
FIG. 14 is a cross-sectional view of the volume-conversion structure of FIG. 13, showing a freezable fluid being frozen in the second reservoir to form a variable stiffness beam.

In this aspect and as shown in FIGS. 13 and 14, at least two rigid plates 1300 are connected with the second reservoir 104 such that the second reservoir 104 is formed therebetween. As the first reservoir 102 is compressed to cause the freezable fluid 1000 to pass from the first reservoir 102 to the second reservoir 104, an increasing amount of the freezable fluid 1000 is disposed within the second reservoir 104, thereby forcing the two rigid plates 1300 further apart. The second reservoir 104 in conjunction with the two rigid plates forms 1300 forms a variable-stiffness beam, such that when the freezable fluid 1000 is within the second reservoir 104 it may be frozen to form a stiff beam 1400.

The beam 1400 is of variable stiffness because a user may control the stiffness of the beam 1400 by controlling its width 1402. As the freezable fluid 1000 is forced into the second reservoir 104, the second reservoir's 104 width 1402 changes. A user may select the desired width and thereafter freeze the freezable fluid 1000. For example, a beam 1400 with a larger width would be stiffer than a beam 1400 with a smaller width.

Figures 15, 16:
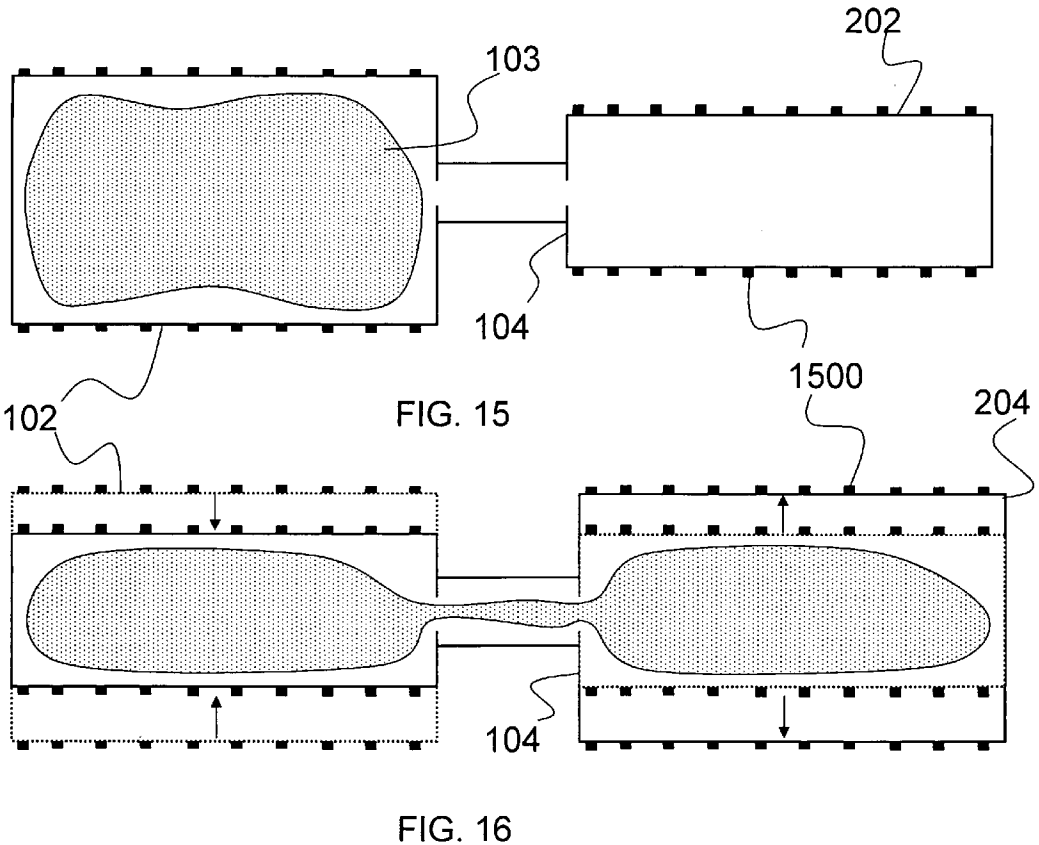
FIG. 15 is a cross-sectional view a volume-conversion structure according to the present invention, showing a skin element circumferentially disposed around the second reservoir.
FIG. 16 is a cross-sectional view of the volume-conversion structure of FIG. 15, showing fluid being displaced from the first reservoir to the second reservoir to cause the second reservoir to change shape from a first-second reservoir configuration to a second-second reservoir configuration.
Figure 17:
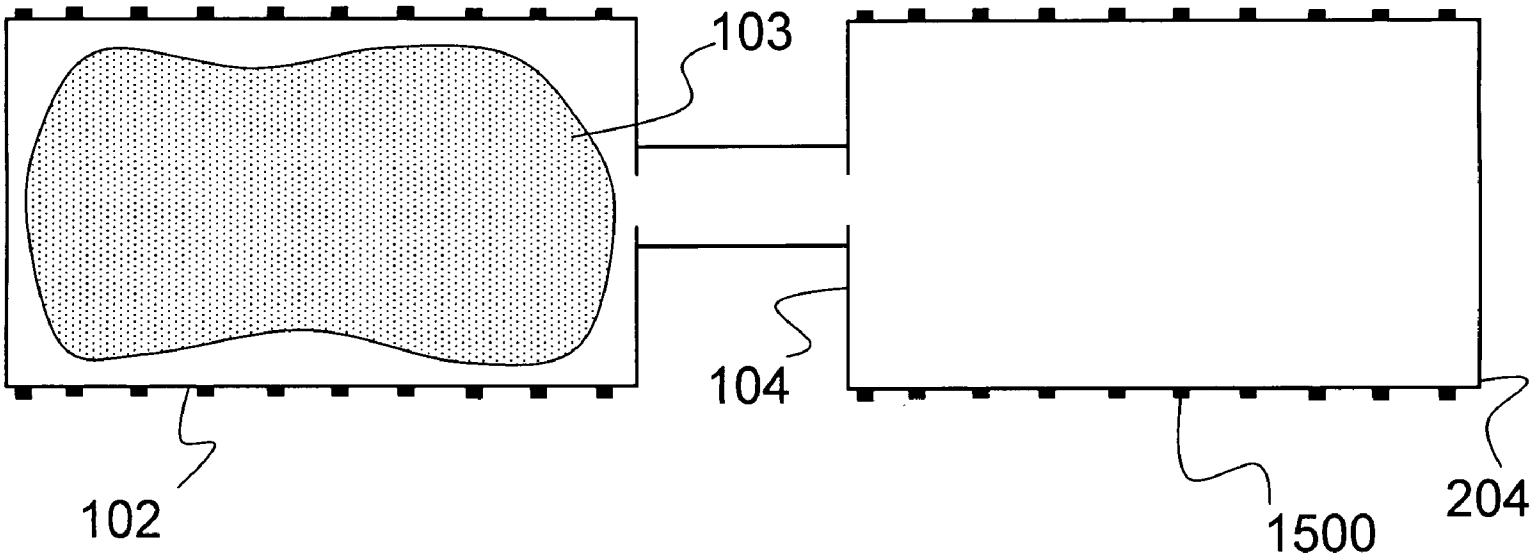
FIG. 17 is a cross-sectional view of the volume-conversion structure of FIG. 16, showing the second reservoir maintaining the second-second reservoir configuration after the fluid has been allowed to leave the second reservoir through activation of the skin element.

In another aspect, and as shown in FIGS. 15 through 17, a skin element 1500 may be circumferentially disposed around the second reservoir 104. The skin element 1500 may be band wrapped around the second reservoir 104, or may form the walls of the second reservoir 104 itself (as shown in FIG. 4 with respect to the first reservoir). The skin element 1500 has a variable stiffness and is responsive to a second deformation activation element, such that the flexibility of the skin 1500 can be altered upon actuation of the second deformation activation element. The skin element 1500 is an actively deformable material structure (ADMS) that includes an actively deformable material, a non-limiting example of which includes a shape memory polymer.

As shown in FIGS. 15 and 16, forcing the fluid 103 from the first reservoir 102 to the second reservoir 104 causes the second reservoir 104 to change its shape from the first-second reservoir configuration 202 into the second-second reservoir configuration 204. As shown in FIG. 17, through activation of the skin element 1500, a user may hold the second reservoir 104 in the second-second reservoir 204 configuration after the fluid 103 has been allowed to leave the second reservoir 104.

Figure 18:
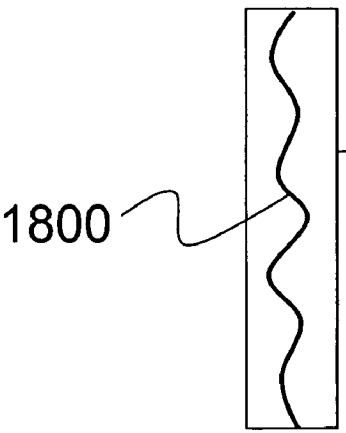
FIG. 18 is a blown up view of the skin element with an activation means disposed therein.

FIG. 18 is a blown up view of the skin element 1500. An activation means 1800 is disposed within the skin element 1500 to allow for selective activation of the actively deformable material in the skin element 1500, thereby allowing a user to selectively freeze the skin element 1500 in the desired shape.

As can be appreciated by one in the art, the shape and structures of the invention described herein can be tailored (e.g., altered) to accomplish a variety of tasks where it is desirable to selectively control the shape of a structure.

What is claimed is:

1. A volume-conversion structure for causing a volume transfer, comprising:

a first reservoir having a first volume for holding a fluid therein, and having a compressible surface area, including an actively deformable material structure disposed around the first reservoir, where the actively deformable material structure is responsive to a deformation activation element to change the actively deformable material structure's shape to cause compression of the first reservoir; and a second reservoir in fluid communication with the first reservoir, the second reservoir having a first-second reservoir configuration and a second-second reservoir configuration, whereby actuation of the deformation activation element causes compression of the actively deformable material structure, thereby compressing the first reservoir to have a smaller second volume and displace the fluid from the first reservoir to the second reservoir to change the second reservoir's configuration from the first-second reservoir configuration to the second-second reservoir configuration.

2. A volume-conversion structure for causing a volume transfer as set forth in claim 1, wherein the actively deformable material structure is disposed around the first reservoir in a form selected from a group consisting of being a material forming the compressible surface area and being separately formed and circumferentially attached with the compressible surface area.

3. A volume-conversion structure for causing a volume transfer as set forth in claim 1, wherein the change from the first-second reservoir configuration to the second-second reservoir configuration is in a form selected from a group consisting of a change in length of the second reservoir, a change in volume of the second reservoir, and a change in geometry of the second reservoir.

4. A volume-conversion structure for causing a volume transfer as set forth in claim 1, further comprising a piston operably connected with the second reservoir, such that a change in the second reservoir's configuration from the first-second reservoir configuration to the second-second reservoir configuration causes the piston to move from a first position to a second position.

5. A volume-conversion structure for causing a volume transfer as set forth in claim 1, wherein the first-second reservoir configuration includes a length with the length rolled onto itself, thereby forming a rolled structure, such that when changed to the second-second reservoir configuration, the rolled structure unrolls and extends out.

6. A volume-conversion structure for causing a volume transfer as set forth in claim 1, where the second reservoir includes a plurality of branches, such that first-second reservoir configuration is a deflated branched structure, and when the fluid is displaced from the first reservoir into the second reservoir, the second-second reservoir configuration is an expanded branched structure.

7. A volume-conversion structure for causing a volume transfer as set forth in claim 1, further comprising an actively controllable valve positioned between the first reservoir and the second reservoir, the valve being positioned such that it controls the fluid connection between the two reservoirs such that once the fluid is displaced from the first reservoir to the second reservoir, the valve prevents the fluid from returning to the first reservoir, thereby holding the second reservoir in the second-second reservoir configuration.

8. A volume-conversion structure for causing a volume transfer as set forth in claim 1, further comprising a freezable fluid disposed within the first reservoir, the freezable fluid having a liquid and solid form, such that when in the liquid form, the freezable fluid may be displaced from the first reservoir to the second reservoir, and once in the second reservoir, when conditions allow, the freezable fluid solidifies to take a solid form, thereby maintaining the second reservoir in the second-second reservoir configuration.

9. A volume-conversion structure for causing a volume transfer as set forth in claim 8, wherein the freezable fluid is a selectively deformable material structure.

10. A volume-conversion structure for causing a volume transfer as set forth in claim 8, further comprising at least two rigid plates connected with the second reservoir such that the second reservoir is sandwiched between the two rigid plates, thereby forming a variable-stiffness beam, whereby as an increasing amount of the freezable fluid is disposed within the second reservoir, a width of the second reservoir increases and thereby forces the two rigid plates further apart, such that when the freezable fluid is within the second reservoir it may be frozen to form a stiff beam, and as the width of the reservoir increases, the stiffness of the second reservoir increases.

11. A volume-conversion structure for causing a volume transfer as set forth in claim 1, further comprising a skin element disposed around the second reservoir, the skin element having a variable stiffness and being responsive to a second deformation activation element, such that the flexibility of the skin element can be altered upon actuation of the second deformation activation element, allowing a user to hold the second reservoir in the second-second reservoir configuration after the fluid has been allowed to leave the second reservoir.

12. A volume-conversion structure for causing a volume transfer as set forth in claim 11, wherein the skin element is formed of a shape memory polymer.

13. A method for forming a volume-conversion structure, the method comprising acts of:

forming a first reservoir having a first volume for holding a fluid therein, and having a compressible surface area, including an actively deformable material structure disposed around the first reservoir, where the actively deformable material structure is responsive to a deformation activation element to change the actively deformable material structure's shape to cause compression of the first reservoir; and forming a second reservoir in fluid communication with the first reservoir, the second reservoir having a first-second reservoir configuration and a second-second reservoir configuration, whereby actuation of the deformation activation element causes compression of the actively deformable material structure, thereby compressing the first reservoir to have a smaller second volume and displace the fluid from the first reservoir to the second reservoir to change the second reservoir's configuration from the first-second reservoir configuration to the second-second reservoir configuration.

14. A method for forming a volume-conversion structure as set forth in claim 13, wherein in the act of forming the first reservoir, the actively deformable material structure is disposed around the first reservoir in a form selected from a group consisting of being a material forming the compressible surface area and being separately formed and circumferentially attached with the compressible surface area.

15. A method for forming a volume-conversion structure as set forth in claim 13, wherein in the act of forming the second reservoir, the second reservoir is formed such that the change from the first-second reservoir configuration to the second-second reservoir configuration is in a form selected from a group consisting of a change in length of the second reservoir, a change in volume of the second reservoir, and a change in geometry of the second reservoir.

16. A method for forming a volume-conversion structure as set forth in claim 13, further comprising an act of operably connecting a piston with the second reservoir, such that a change in the second reservoir's configuration from the first-second reservoir configuration to the second-second reservoir configuration causes the piston to move from a first position to a second position.

17. A method for forming a volume-conversion structure as set forth in claim 13, wherein in the act of forming the second reservoir, the second reservoir is formed such that the first-second reservoir configuration includes a length with the length rolled onto itself, thereby forming a rolled structure, such that when changed to the second-second reservoir configuration, the rolled structure unrolls and extends out.

18. A method for forming a volume-conversion structure as set forth in claim 13, wherein in the act of forming the second reservoir, the second reservoir is formed such that the second reservoir includes a plurality of branches, such that first-second reservoir configuration is a deflated branched structure, and when the fluid is displaced from the first reservoir into the second reservoir, the second-second reservoir configuration is an expanded branched structure.

19. A method for forming a volume-conversion structure as set forth in claim 13, further comprising an act of positioning an actively controllable valve between the first reservoir and the second reservoir, the valve being positioned such that it controls the fluid connection between the two reservoirs such that once the fluid is displaced from the first reservoir to the second reservoir, the valve prevents the fluid from returning to the first reservoir, thereby holding the second reservoir in the second-second reservoir configuration.

20. A method for forming a volume-conversion structure as set forth in claim 13, further comprising an act of disposing a freezable fluid within the first reservoir, the freezable fluid having a liquid and solid form, such that when in the liquid form, the freezable fluid may be displaced from the first reservoir to the second reservoir, and once in the second reservoir, when conditions allow, the freezable fluid solidifies to take a solid form, thereby maintaining the second reservoir in the second-second reservoir configuration.

21. A method for forming a volume-conversion structure as set forth in claim 20, wherein in the act of disposing a freezable fluid within the first reservoir, the freezable fluid is a selectively deformable material structure.

22. A method for forming a volume-conversion structure as set forth in claim 20, further comprising an act of connecting at least two rigid plates with the second reservoir such that the second reservoir is sandwiched between the two rigid plates, thereby forming a variable-stiffness beam, whereby as an increasing amount of the freezable fluid is disposed within the second reservoir, a width of the second reservoir increases and thereby forces the two rigid plates further apart, such that when the freezable fluid is within the second reservoir it may be frozen to form a stiff beam, and as the width of the reservoir increases, the stiffness of the second reservoir increases.

23. A method for forming a volume-conversion structure as set forth in claim 13, further comprising an act of disposing a skin element around the second reservoir, the skin element having a variable stiffness and being responsive to a second deformation activation element, such that the flexibility of the skin element can be altered upon actuation of the second deformation activation element, allowing a user to hold the second reservoir in the second-second reservoir configuration after the fluid has been allowed to leave the second reservoir.

24. A method for forming a volume-conversion structure as set forth in claim 23, wherein in the act of disposing the skin element around the second reservoir, the skin element is formed of a shape memory polymer.

25. A method for volume-conversion, the method comprising acts of:

selecting a volume-conversion structure having both a first reservoir and a second reservoir, where the first reservoir includes a first volume for holding a fluid therein, and having a compressible surface area, including an actively deformable material structure disposed around the first reservoir, where the actively deformable material structure is responsive to a deformation activation element to change the actively deformable material structure's shape to cause compression of the first reservoir; and where the second reservoir is in fluid communication with the first reservoir, the second reservoir having a first-second reservoir configuration and a second-second reservoir configuration; and actuating the deformation activation element to cause compression of the actively deformable material structure, whereby actuation of the deformation activation element causes compression of the actively deformable material structure, thereby compressing the first reservoir to have a smaller second volume and displace the fluid from the first reservoir to the second reservoir to change the second reservoir's configuration from the first-second reservoir configuration to the second-second reservoir configuration.

26. A method for volume-conversion as set forth in claim 25, further comprising an act of selecting a volume-conversion structure such that the actively deformable material structure is disposed around the first reservoir in a form selected from a group consisting of being a material forming the compressible surface area and being separately formed and circumferentially attached with the compressible surface area.

27. A method for volume-conversion as set forth in claim 25, further comprising an act of selecting a volume-conversion structure such that the change from the first-second reservoir configuration to the second-second reservoir configuration is in a form selected from a group consisting of a change in length of the second reservoir, a change in volume of the second reservoir, and a change in geometry of the second reservoir.

28. A method for volume-conversion as set forth in claim 25, further comprising an act of selecting a volume-conversion structure such that the volume-conversion structure includes a piston operably connected with the second reservoir, such that a change in the second reservoir's configuration from the first-second reservoir configuration to the second-second reservoir configuration causes the piston to move from a first position to a second position.

29. A method for volume-conversion as set forth in claim 25, further comprising an act of selecting a volume-conversion structure such that the first-second reservoir configuration includes a length with the length rolled onto itself, thereby forming a rolled structure, such that when changed to the second-second reservoir configuration, the rolled structure unrolls and extends out.

30. A method for volume-conversion as set forth in claim 25, further comprising an act of selecting a volume-conversion structure such that the second reservoir includes a plurality of branches, such that first-second reservoir configuration is a deflated branched structure, and when the fluid is displaced from the first reservoir into the second reservoir, the second-second reservoir configuration is an expanded branched structure.

31. A method for volume-conversion as set forth in claim 25, further comprising an act of selecting a volume-conversion structure such that the volume-conversion structure includes an actively controllable valve positioned between the first reservoir and the second reservoir, the valve being positioned such that it controls the fluid connection between the two reservoirs such that once the fluid is displaced from the first reservoir to the second reservoir, the valve prevents the fluid from returning to the first reservoir, thereby holding the second reservoir in the second-second reservoir configuration.

32. A method for volume-conversion as set forth in claim 25, further comprising an act of selecting a volume-conversion structure such that the volume-conversion structure includes a freezable fluid disposed within the first reservoir, the freezable fluid having a liquid and solid form, such that when in the liquid form, the freezable fluid may be displaced from the first reservoir to the second reservoir, and once in the second reservoir, when conditions allow, the freezable fluid solidifies to take a solid form, thereby maintaining the second reservoir in the second-second reservoir configuration.

33. A method for volume-conversion as set forth in claim 32, wherein the freezable fluid is a selectively deformable material structure.

34. A method for volume-conversion as set forth in claim 32, further comprising an act of selecting a volume-conversion structure such that the volume-conversion structure includes at least two rigid plates connected with the second reservoir such that the second reservoir is sandwiched between the two rigid plates, thereby forming a variable-stiffness beam, whereby as an increasing amount of the freezable fluid is disposed within the second reservoir, a width of the second reservoir increases and thereby forces the two rigid plates further apart, such that when the freezable fluid is within the second reservoir it may be frozen to form a stiff beam, and as the width of the reservoir increases, the stiffness of the second reservoir increases.

35. A method for volume-conversion as set forth in claim 25, further comprising an act of selecting a volume-conversion structure such that the volume-conversion structure includes a skin element disposed around the second reservoir, the skin element having a variable stiffness and being responsive to a second deformation activation element, such that the flexibility of the skin element can be altered upon actuation of the second deformation activation element, allowing a user to hold the second reservoir in the second-second reservoir configuration after the fluid has been allowed to leave the second reservoir.

36. A method for volume-conversion as set forth in claim 35, wherein the skin element is formed of a shape memory polymer.

* * * * *